US010247364B2

(12) United States Patent
Cao et al.

(10) Patent No.: US 10,247,364 B2
(45) Date of Patent: Apr. 2, 2019

(54) METHOD FOR INSTALLING LED LIGHT BAR INTO LIGHT BULB AND DEVICE

(71) Applicant: XIAMEN ECO LIGHTING CO. LTD., Xiamen (CN)

(72) Inventors: Liangliang Cao, Xiamen (CN); Lilei Su, Xiamen (CN); Wanzhen Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 34 days.

(21) Appl. No.: 15/435,296

(22) Filed: Feb. 17, 2017

(65) Prior Publication Data

US 2018/0112833 A1 Apr. 26, 2018

(30) Foreign Application Priority Data

Oct. 21, 2016 (CN) ..... 2016 1 0919476

(51) Int. Cl.

| | |
|---|---|
| ***F21K 9/90*** | (2016.01) |
| ***F21S 4/28*** | (2016.01) |
| ***F21K 9/237*** | (2016.01) |
| ***F21V 29/89*** | (2015.01) |
| ***F21K 9/238*** | (2016.01) |
| ***F21K 9/232*** | (2016.01) |
| ***F21V 3/02*** | (2006.01) |
| ***F21V 17/10*** | (2006.01) |
| ***F21V 23/06*** | (2006.01) |
| *F21Y 115/10* | (2016.01) |
| *F21Y 107/70* | (2016.01) |

(52) U.S. Cl.

CPC ..... *F21K 9/237* (2016.08); *F21K 9/232* (2016.08); *F21K 9/238* (2016.08); *F21K 9/90* (2013.01); *F21V 3/02* (2013.01); *F21V 17/101* (2013.01); *F21V 23/06* (2013.01); *F21V 29/89* (2015.01); *F21Y 2107/70* (2016.08); *F21Y 2115/10* (2016.08)

(58) Field of Classification Search

CPC ..... F21K 9/232; F21K 9/238; F21K 9/237; F21K 9/90; F21S 4/20; F21S 4/24; F21V 17/101; F21V 3/00; F21V 23/005; F21V 29/004; F21V 29/508; F21V 29/70; F21Y 2107/10; H05B 37/02; H05B 37/029; H05K 1/181

See application file for complete search history.

(56) References Cited

U.S. PATENT DOCUMENTS 5,585,783 A * 12/1996 Hall ..... B60Q 7/00 340/473
5,806,965 A * 9/1998 Deese ..... B64F 1/20 362/237

(Continued)

*Primary Examiner* — Hargobind S Sawhney
(74) *Attorney, Agent, or Firm* — Chun-Ming Shih

(57) ABSTRACT

A method for installing a LED light bar into a light bulb. First, place a light module into bulb shell. The light bar module has a plurality of LED light bars and expansion structure. The expansion structure is unexpanded and disposed between the plurality of LED light bars. Each LED light bar has a certain bending property. Expending the expansion structure could make the plurality of LED light bars bent to the direction of bulb shell individually. And then, remove the expansion module and install the other components of the bulb.

11 Claims, 9 Drawing Sheets

(56) References Cited

U.S. PATENT DOCUMENTS

| | | | | |
|---|---|---|---|---|
| 6,276,822 | B1 * | 8/2001 | Bedrosian | F21S 41/143 362/545 |
| 6,523,978 | B1 * | 2/2003 | Huang | F21V 3/00 313/500 |
| 6,709,132 | B2 * | 3/2004 | Ishibashi | F21V 3/00 257/E25.028 |
| 7,354,174 | B1 * | 4/2008 | Yan | F21V 23/005 313/512 |
| 7,726,836 | B2 * | 6/2010 | Chen | H05K 1/14 361/760 |
| 7,824,065 | B2 * | 11/2010 | Maxik | F21K 9/00 362/234 |
| 8,360,622 | B2 * | 1/2013 | Mora | F21V 29/70 362/498 |
| 8,421,322 | B2 * | 4/2013 | Carroll | F21V 3/02 313/46 |
| 9,285,082 | B2 * | 3/2016 | Athalye | F21V 29/70 |
| 9,822,933 | B2 * | 11/2017 | Rao | F21K 9/232 |
| 2005/0174769 | A1 * | 8/2005 | Yong | F21V 3/02 362/235 |
| 2014/0268771 | A1 * | 9/2014 | Heikman | F21V 29/004 362/249.02 |
| 2015/0323139 | A1 * | 11/2015 | Tseng | F21K 9/232 362/650 |

* cited by examiner

METHOD FOR INSTALLING LED LIGHT BAR INTO LIGHT BULB AND DEVICE

FIELD OF THE INVENTION

The present disclosure relates to a method for installing a light bar into a light bulb and bulb device and lighting device by the same, and more particularly to a method for installing a light emitted diode light bar into a light bulb and bulb device and lighting device by the same.

BACKGROUND OF INVENTION

Lighting is an important part of human life, and plays an increasingly important role. With the evolution and development of technology, the technology of light emitted diode is widely used in daily lighting device. The luminous efficiency of light emitted diode is usually higher than the traditional tungsten or fluorescent lamps. In addition, the manufacturing cost of the light emitted diodes decreased continually with the manufacturing technology improvement. This has led to more people developing more light emitted diode lighting devices.

On the other hand, although the luminous efficiency of light emitted diode is quite high, either the drive circuit or the light emitted diode itself will produce a certain amount of heat during continuous operation. If there is no effective way to remove these heat, it often will affect the service life of the lighting device itself.

In addition, how to effectively improve the location and angle for light emitted diode to emit light, will also affect the real lighting efficiency of the lighting device.

Therefore, the continuous development of light emitted diodes has always been a very valuable work.

SUMMARY OF INVENTION

The first embodiment of the instant disclosure provides a method for installing a light emitted diode light bar into a light bulb. First, place the light module into the bulb shell. The shape of bulb shell could be traditional bulb type, candle bulb shell type, flat-head type, polygonal shape, special shape or other shapes. The bulb shell has a certain degree of translucent, so the light will be emitted out from the surface of the bulb when place the light emitting device into the bulb. The surface of the bulb shell could be fully transparent, partly translucent, atomized, smooth or rough shell. The material of the bulb shell may be glass, plastic, or other light translucent material.

In some common bulb cases, there is often a neck portion with a relatively small diameter and a top portion with a larger diameter. In other words, in order to place the light emitted element into the bulb shell, it is necessary to pass through the small diameter neck portion. The inventive concept described below can be used in this construction, or a bulb shell with a not very thin neck portion or other bulb shells in different shapes.

Light module consists of a number of LED light bar. Every LED light bar could may be provided with one or more light emitted diode cores on the substrate, and the substrates are made of different materials. Depending on the different designs of the bulb, such as the luminous position and the associated specifications, the cores can be spread evenly over the LED light bar. In other designs, for example, in order to make the overall luminescence effect more uniform, more LED cores could be placed in the corresponding region of the LED light bar, where is near the middle part of the bulb shell.

The substrate mentioned herein may be made of glass material, aluminum material, alloy material, plastic material, or other various materials. In order to connect the LED cores to the substrate, different materials such as metal conductive wires, transparent conductive wires and graphene conductive wires can be used.

Initially, the expansion structure is not expanded and is disposed between the plurality of LED bars. Every LED light bar has a certain bending property. In other words, these LED light bars can be deformed by an external force.

The overall width of the LED light bar can be designed to be less than the neck width of the bulb shell. In other words, the LED light bar can be placed inside the bulb shell before being expanded. Then, the LED light bars are stretched by the expansion structure, so that some of these LED light bars would deform in the direction toward the bulb shell.

In some embodiments, a portion or all of the LED light bars may directly contact the inner wall of the bulb shell. In other embodiments, LED light bars may also be moved only in one direction toward to the position near the bulb shell. This can bring a very significant improvement for the effect of cooling and light source.

Due to the expansion, the curvature of said LED light bar changed and further changed the position distribution of the integral light bar module in the bulb shell. Thereafter, the expansion structure is reduced to make the expansion structure removed from the neck portion of the bulb shell smoothly. And then, other components of the bulb may be mounted, such as a driver circuit board, a wireless circuit, or other related components. In a typical light bulb embodiment, the bulb holder is finally mounted to conduct an external power supply.

In some embodiments, the expansion structure may be an inflatable balloon. The specific operation method involves placing the uninflated balloon between a plurality of LED light bars of the light bar module. At this time, the balloon and the plurality of LED light bars can pass through the neck portion of the bulb shell together.

Next, insert the balloon and the light bar module into the bulb shell through the neck portion of the bulb shell. Next, inflate the balloon. The balloon expands during inflation and its outer wall abuts against the LED light bar and then generates an external force for bending the LED light bar. The LED light bar approaches toward the inner wall of the bulb during the bending deformation. In some embodiments, a portion or all of the LED light bars directly contact to the inner wall of the bulb shell.

In one embodiment, the LED light bar has two or more light bar sections, and a partitioned portion located between the sections. The LED light bar bent at the partitioned portion when said expansion structure resisted said light bar module and deformed. In some designs, the partitioned portion can maintain its original shape in the absence of force. In other words, the originally partitioned portions keep the connected light bar section straight, while in the case of external force, an angle generated between the light bars. After the release of external force, because of a certain rigidity of the partitioned portion, the relative bending angle between the light bar sections can be maintained at that time.

In another embodiment, the substrate of the LED light bar is a flexible circuit board. It can be bent under a certain external force, and maintained the shape at that time after the external force removed. For example, the flexible circuit board may be made of aluminum or other material. When the external force exceeds a certain limit, the LED light bar will bend. However, after the external force disappeared, the LED light bar can maintain its curved shape due to the rigidity of the flexible circuit board itself.

In addition, glue can be applied to all or a portion of the LED light bar. Specially, the glue could a cooling glue. When the LED light bar contacts to the inner wall of the bulb shell because of the external force, which is produced by balloon expansion, the glue can make the LED light bar fixed better with the inner wall of the bulb shell. For example, the LED light bar will not damaged because of shifting or shaking during transport. Another approach is to apply the cooling glue to the inner wall of the bulb shell.

In addition, the core of LED can be placed on both sides or one side of the LED light bar. In order to further enhance the cooling effect, some cooling elements, such as aluminum, cooling glue, etc., can be placed on partial or full of one side or both sides of the LED light bar.

In addition, it could be the side with core of the LED light bar toward or contact the side wall of the bulb shell. Alternatively, the side with core also can away from the position near the side wall of the bulb shell. In other words, the LED core can directly emit light toward the inner wall of the closest bulb shell. Or, the LED core may also emit light toward a location further away from the inner wall of the bulb. In this case, a cooling glue further can be applied to the LED light, which near to or contact to a side of the bulb shell, so the heat of the LED light bar can be dissipated through the inner wall of the bulb.

In addition, in another embodiment, the bulb shell and the LED light bar may form a corresponding clamping structures. When the bulb shell is contacted with the LED light bar, the bulb shell and the LED light bar are engaged with each other through the corresponding clamping structure. These clamping structures may be of different configurations such as block, groove, hook, buckle, etc., and the aim is to provide a more stable connection between the LED light bar and the bulb shell.

In addition to LED light bars, light bulbs usually have other components, such as drive circuit, wireless circuit, speaker, or other element, circuit, etc., which is set for different circumstances. These components, such as the drive circuit, may be connected to the LED light bar by welding or clamping structural. These LED light bars may be electrically connected to each other in series or in another manner. Alternatively, in another embodiment, the plurality of LED light bars may not be contacted with each other.

In one embodiment, the plurality of LED light bars may be connected at the top. Of course, in other embodiments, these LED light bars may also be disconnected.

In this application, a LED light bar can also be logically divided into two parts, known as the LED light bar individually, and thus referred to as the "the plurality of LED light bars".

In addition, apart from the plurality of LED light bars described above, another light emitting module may be additionally placed in the same bulb shell. In other words, for example, in order to obtain a stronger light source, a plurality of LED light bars may be provided on a position near the inner wall of the bulb. In addition, a light emitting module, such as a light source plate, or even another group of LED light bars is additionally provided in the center of the bulb shell, surrounded by the plurality of LED light bars described above.

Another embodiment of the instant disclosure provides a bulb device, comprising a bulb shell, a light bar module, a driving circuit and a bulb holder. A The light bar module is mounted in said bulb shell. The light bar module has a plurality of LED light bars, which is expanded toward the position near the inner edge of the bulb shell individually. In the first embodiment, a part or all of the LED light bars directly contact the inside of the bulb shell, so that the heat dissipation effect can be increased. In another embodiment, a part or all of the LED light bars do not directly contact the bulb shell, but expanded a certain degree along the inner wall of the bulb shell. For example, the bulb shell has a relatively narrow neck portion. These LED light bars are closer to each other at the positions corresponding to the neck portions of the bulb shells, and deployed at the position away from the neck portions to get closer to the inner wall of the bulb shell. As the bulb shell itself is an important source of heat, the LED light bulb closer to the shell, the cooling effect is usually better. On the other hand, because of expanding, the heat generated by the LED light bar would not be interfered or overlaid by each other. In particular, the temperature near the LED light bar is often one of the key factors in determining the service life of the LED light bar.

The bulb device also has a drive circuit connected to said light bar module. The bulb holder has two electrical connection terminals for connecting external power to said drive circuit and then driving said light bar module to generate illumination.

As described above, said LED light bar has two or more light bar sections, and a partitioned portion located between the sections. Said plurality of LED light bars are capable of being individually expanded toward the position near the inner edge of the bulb shell and deformed when the plurality of LED light bars are expanded outwardly by an expanding structure.

The substrate of said every LED light bar could be a flexible circuit board. It can be bent under a certain external force, and maintained the shape at that time after the external force removed.

In addition, a glue can be applied to a predetermined position of said LED light bar, and said LED light bar and said bulb shell are fixed through said glue.

In addition, said bulb shell and said LED light bar may have a corresponding clamping structures. Said bulb shell and said LED light bar are engaged with each other through said corresponding clamping structure.

In some embodiments, said plurality of LED light bars of the light bar module are connected at the top. This approach can make the assembly is not easy to break up.

In one embodiment, said LED light bar is provided with a cooling element, such as aluminum or cooling glue, and the like, at a position facing the back of the bulb shell.

In addition, in another embodiment, another light emitting module may additionally be added, and located between said plurality of LED light bars.

In another embodiment, said light bar module comprises two or more sub-light bar modules, each has a plurality of LED light bars, respectively.

In addition to being made into a light bulb product, the inventive concept described above also can be used as other lighting devices. The illumination device has a translucent shell, and the above-described light bar module. For example, such a lighting device may be a flashlight, table lamp, lamps depend on battery or other various products in lighting or indicating assembly.

In addition to these practices, the LED light bars may also be provided on a substrate having a certain elasticity to reduce the overall width between the LED light bars before plunging into the neck of the bulb shell. When the LED light bar is inserted into the bulb shell, and it will be expanded because of the elasticity of the LED light bar. A shrinkable band which may be melted by heating, or other operable wires, etc. also can be used for such assembling operations.

In addition, it is not quite necessarily for the LED light bar to extend from the neck portion of the bulb to the upper portion. For example, the LED light bar may be spiral extended, or the direction of extension is perpendicular to the direction from the neck of the bulb into the bulb. Other arrangements of the LED light bar should also be considered as other embodiments of the invention.

DETAILED DESCRIPTION OF THE PREFERRED EMBODIMENTS

Figure 1:
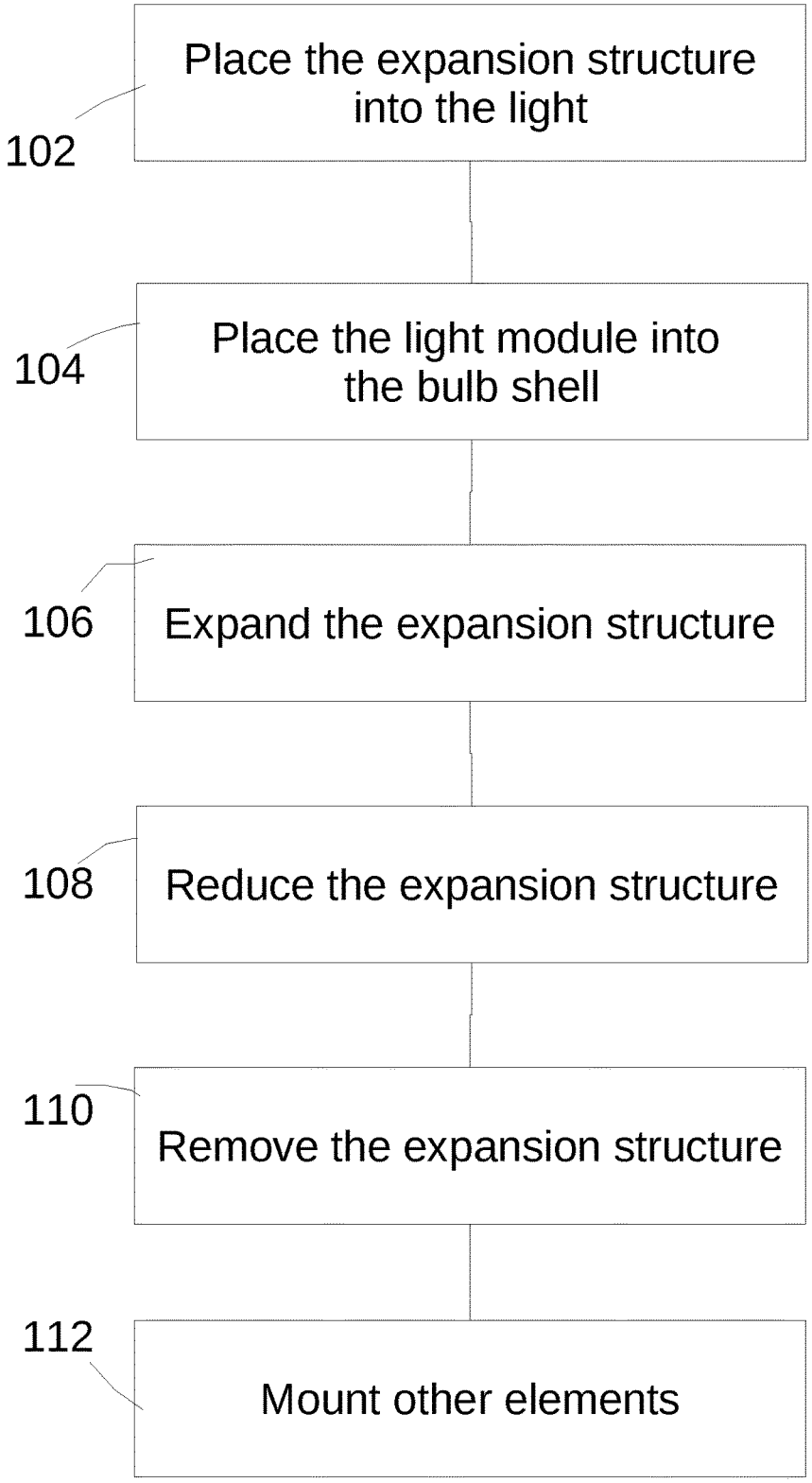
FIG. 1 illustrates a method of assembling a bulb device according to an embodiment of the present disclosure.

Please refer to FIG. 1. FIG. 1 illustrates a method of assembling a bulb device according to an embodiment of the present disclosure. According to the first embodiment of the present invention, a method of mounting a LED light bar in a bulb is provided. First, place the expansion structure into the light module (step 102). Second, place the light module into the bulb shell (step 104). The shape of bulb shell could be traditional bulb type, candle bulb shell type, flat-head type, polygonal shape, special shape or other shapes. The bulb shell has a certain degree of translucent, so the light will be emitted out from the surface of the bulb when placed the light emitted device into the bulb. The surface of the bulb shell could be fully transparent, partly translucent, atomized, smooth or rough shell. The material of the bulb shell may be glass, plastic, or other light translucent material.

In some common bulb cases, there is often a neck portion with a relatively small diameter and a top portion with a larger diameter. In other words, in order to place the light emitted element into the bulb shell, it is necessary to pass through the small diameter neck portion. The inventive concept described below can be used in this construction, or a bulb shell with a not very thin neck portion or other bulb shells in different shapes.

Light module consists of a number of LED light bar. Every LED light bar may be provided with one or more light emitted diode cores on the substrate, and the substrates are made of different materials. Depending on the different design of the bulb, such as the luminous position and the associated specifications, the cores can be spread evenly over the LED light bar.

Figure 3:
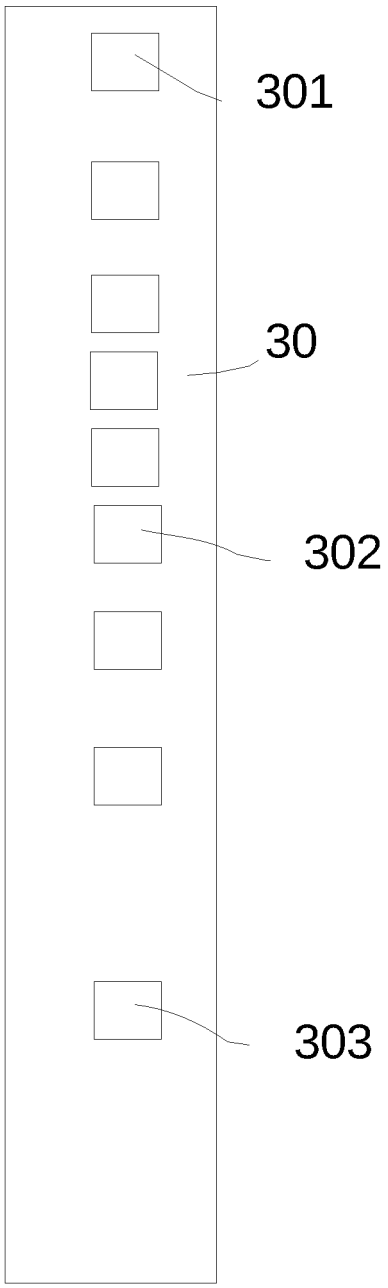
FIG. 3 illustrates a schematic view of a LED light bar according to an embodiment of the present disclosure.

Please refer to FIG. 3. FIG. 3 illustrates a schematic view of a LED light bar according to an embodiment of the present disclosure. In FIG. 3, the light bar 30 may be divided into several different regions from the neck position to the top of the bulb shell. For example, the LED core 303 is in a position near the neck of the bulb shell, the LED core 302 is in a position near the center of the bulb shell, and the LED core 301 is in a position near the top of the bulb shell. In this case, in order to achieve a more uniform lighting effect, more LED cores could be placed in the region near the middle part of the bulb shell. In other embodiments, the distribution of the different LED cores can be made depends on different positions of the light bar relative to the bulb shell. For example, for different shapes of bulb shells, we can use optical simulation software simulation, or the actual product assembly's measurement to determine the distribution of the LED cores on the light bar regions for bulb shell with different shapes, extended light bar or bent light bar.

In addition, it is possible to analyze the temperature of the different regions of the bulb, in the special case of the light bar expanded, to find out the best combination of different number of LED cores in different light bar position.

The substrate mentioned herein may be made of glass material, aluminum material, alloy material, plastic material, or other various materials. In order to connect the LED cores to the substrate, different materials such as metal conductive wires, transparent conductive wires and graphene conductive wires can be used.

Initially, the expansion structure is not expanded and is disposed between the plurality of LED bars. Every LED light bar has a certain bending property. In other words, these LED light bars can be deformed by an external force.

The overall width of the LED light bar can be designed to be less than the neck width of the bulb shell. In other words, the LED light bar can be placed inside the bulb shell before being expanded. Then, stretch the LED light bars by the expansion structure (step 106), so that some of these LED light bars are deformed in the direction toward the bulb shell.

In some embodiments, a portion or all of the LED light bars may directly contact the inner wall of the bulb shell. In other embodiments, LED light bars may also be moved only in one direction toward to the position near to the bulb shell. This can bring a very significant improvement for the effect of cooling and light source.

Due to the expansion, the curvature of said LED light bar changed and further changed the position distribution of the integral light bar module in the bulb shell. Thereafter, the expansion structure is reduced (step 108) to make the expansion structure removed from the neck portion of the bulb shell smoothly (step 110). And then, other components of the bulb may be mounted, such as a driver circuit board, a wireless circuit, or other related elements (step 112). In a typical light bulb embodiment, the bulb holder is finally mounted to conduct an external power supply.

Figure 2:
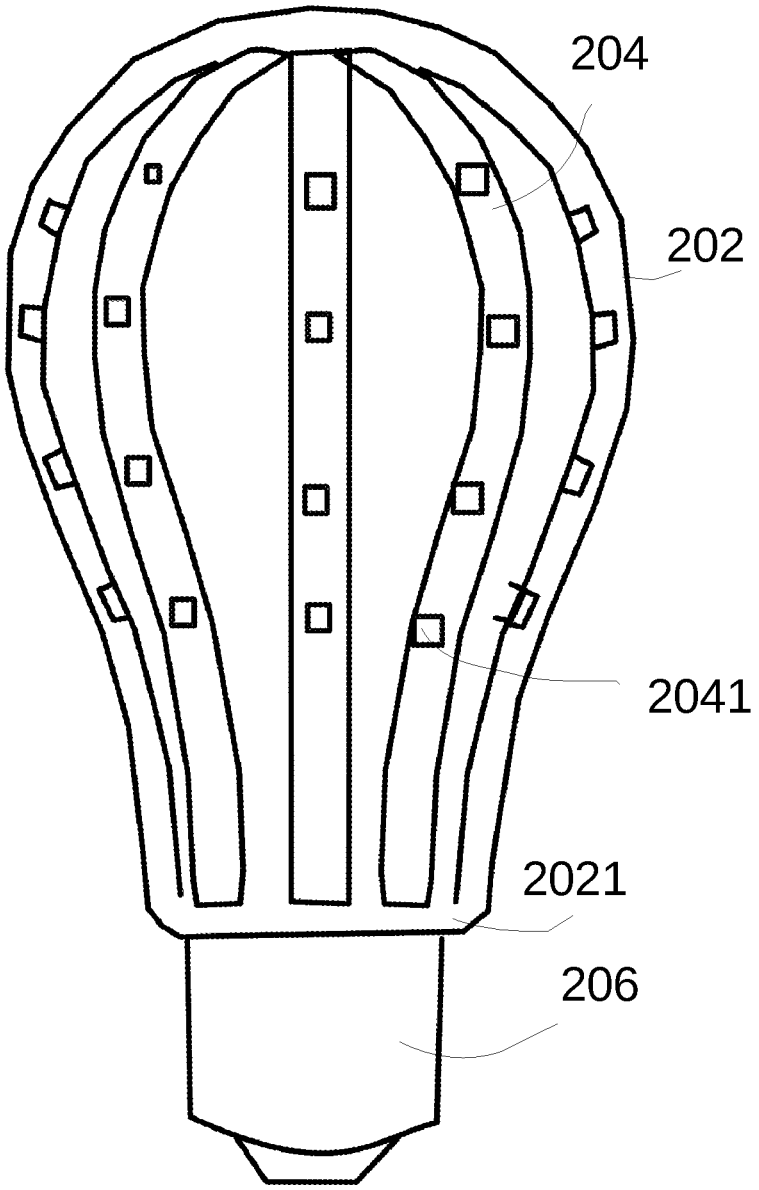
FIG. 2 illustrates a schematic view of a bulb device according to an embodiment of the present disclosure.

Please refer to FIG. 2. FIG. 2 illustrates a schematic view of a bulb device according to an embodiment of the present disclosure. In FIG. 2, a plurality of light bars 204 are provided inside bulb shell 202, and corresponding LED core 2041 are disposed on the respective light bars. In this example, the light bar 204 is connected to a drive circuit (not shown) of the bulb holder 206 and extends upwardly from the neck portion 2021 of the bulb shell 202. In this example, it can be seen that the neck portion of the bulb shell 202 has a narrower channel than the other, and that the plurality of light bars 204 are deployed closer to the inner wall of the bulb 202 or directly connect to the inner wall of the bulb 202. In this way, the heat can be more efficiently diffused outwardly through the bulb shell 202. At the same time, the heat between the light bars 204 will not accumulated, and the localized temperature would not be too high, so it would not result in an interruption or deterioration in the quality of the light bar 204.

Figure 4A:
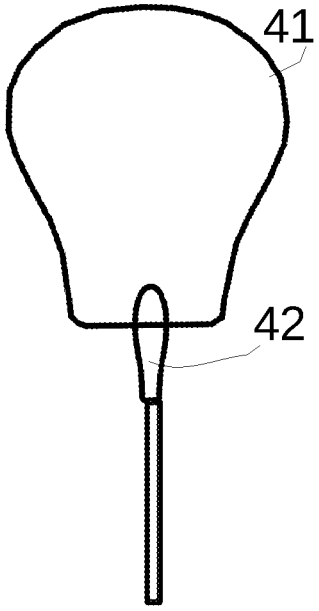
FIG. 4A illustrates a schematic view of the first state in which the LED light bar is provided using an balloon according to an embodiment of the present disclosure.
Figure 4B:
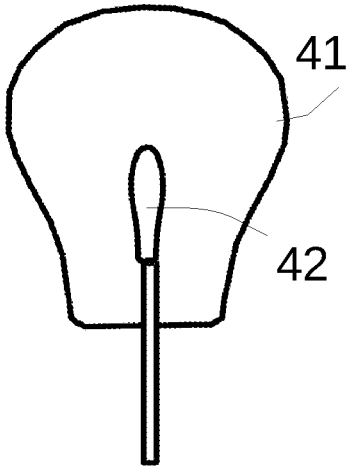
FIG. 4B illustrates a schematic view of the second state in which the LED light bar is provided using an balloon according to an embodiment of the present disclosure.
Figure 4C:
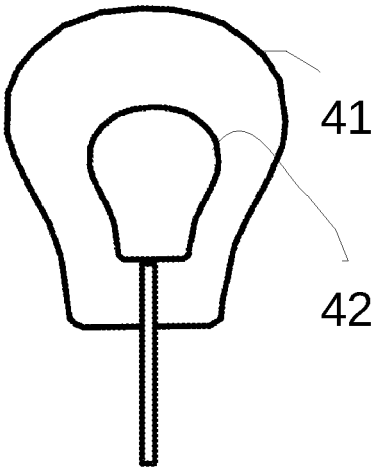
FIG. 4C illustrates a schematic view of the third state in which the LED light bar is provided using a balloon according to an embodiment of the present disclosure.
Figure 4D:
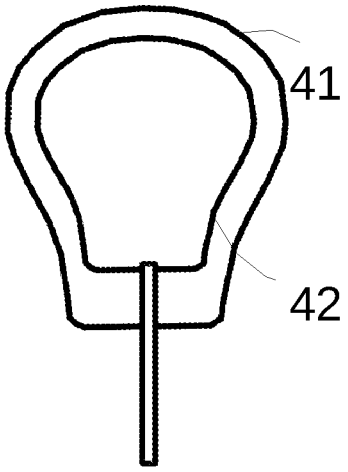
FIG. 4D illustrates a schematic view of the forth state in which the LED light bar is provided using a balloon according to an embodiment of the present disclosure.

In some embodiments, the expansion structure may be an inflatable balloon. Please refer to FIG. 4. FIG. 4A illustrates a schematic view of the first state in which the LED light bar is provided using a balloon according to an embodiment of the present disclosure. FIG. 4B illustrates a schematic view of the second state in which the LED light bar is provided using a balloon according to an embodiment of the present disclosure. FIG. 4C illustrates a schematic view of the third state in which the LED light bar is provided using a balloon according to an embodiment of the present disclosure. FIG. 4D illustrates a schematic view of the forth state in which the LED light bar is provided using a balloon according to an embodiment of the present disclosure.

As shown in FIG. 4A and FIG. 4B, the uninflated balloon 42 is placed between a plurality of LED light bars (not shown) of the light bar module. At this time, the balloon 42 and the plurality of LED light bars can pass through the neck portion of the bulb shell 41 together.

As shown in FIG. 4C and FIG. 4D, Next, insert the balloon 42 and the light bar module into the bulb shell 41 through the neck portion of the bulb shell. Next, inflate the balloon 42. The balloon 42 expands during inflation and its outer wall abuts against the LED light bar (not shown), and then generates an external force for bending the LED light bar. The LED light bar approaches toward the inner wall of the bulb 41 during the bending deformation. In some embodiments, a portion or all of the LED light bars directly contact to the inner wall of the bulb shell.

Figure 5:
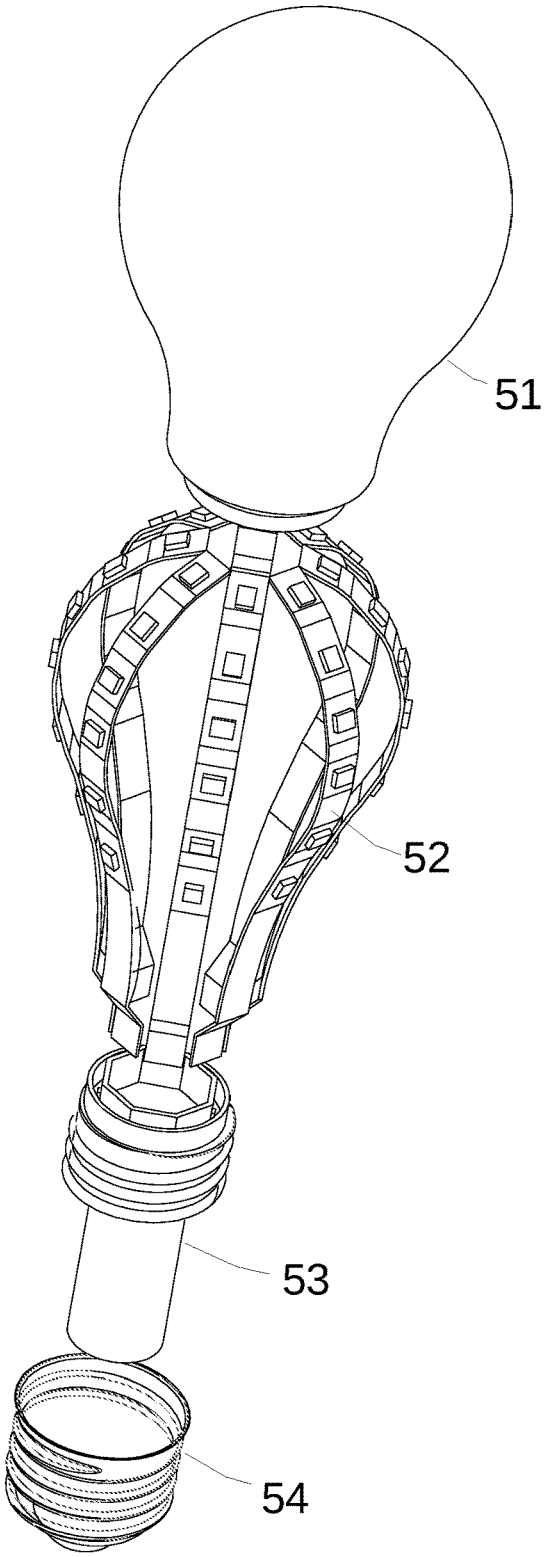
FIG. 5 illustrates an exploded schematic view of the bulb unit assembly according to an embodiment of the present disclosure.

Please refer to FIG. 5. FIG. 5 illustrates an exploded schematic view of the bulb unit assembly according to an embodiment of the present disclosure. In FIG. 5, the bulb device includes some main components such as a bulb shell 51, a plurality of LED light bars 52 extended toward the bulb shell 51, a driving circuit 53, and a bulb holder 54 surrounded the driving circuit 53. As can be seen from FIG. 5, the above-described assembly allows the expanded light bar 52 to pass through the neck portion of the bulb shell 51 and near the inner wall of the bulb shell 51, but before that, the expanded light bar can not pass through the neck portion of the bulb shell 51.

Figure 6A:
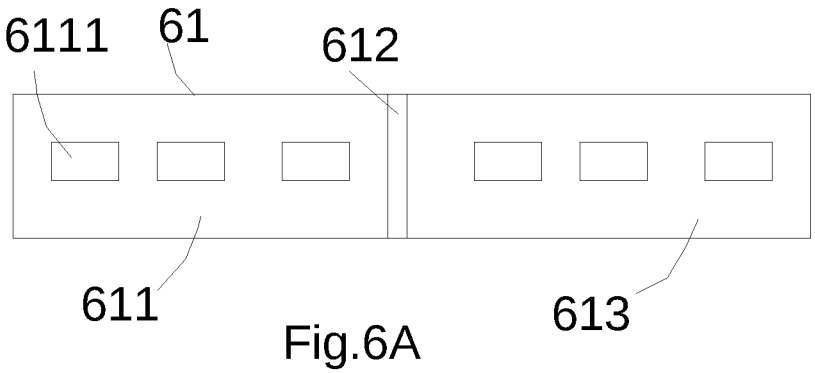
FIG. 6A illustrates a top view of the partial LED light bar according to an embodiment of the present disclosure.
Figure 6B:
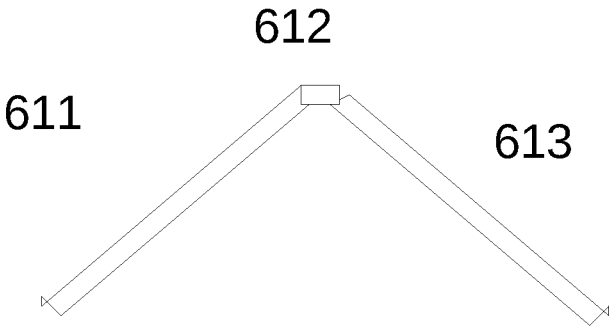
FIG. 6B illustrates a side view of a bent partial LED light bar according to an embodiment of the present disclosure.
Figure 6C:
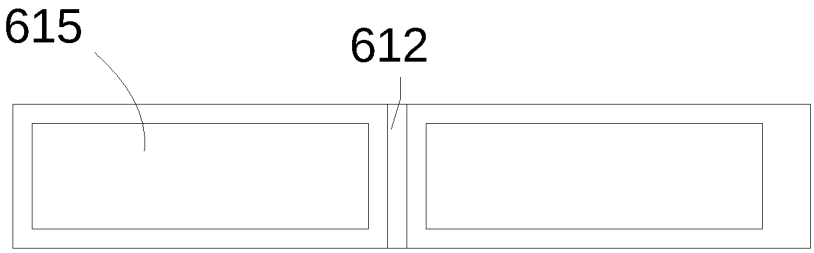
FIG. 6C illustrates a bottom view of the partial LED light bar according to an embodiment of the present disclosure.

Please refer to FIG. 6A, 6B, and 6C. FIG. 6A illustrates a top view of the partial LED light bar according to an embodiment of the present disclosure. FIG. 6B illustrates a side view of a bent partial LED light bar according to an embodiment of the present disclosure. FIG. 6C illustrates a bottom view of the partial LED light bar according to an embodiment of the present disclosure. In one embodiment, the LED light bar 61 has two or more light bar sections 611, 613. There is a light bar core 6111 in the light bar section 611. A partitioned portion 612 located between the light bar sections 611, 613. The LED light bar 61 bent at the partitioned portion 612 when said expansion structure resisted said light bar module and deformed, as shown in FIG. 6B. In some designs, the partitioned portion 612 can maintain its original shape in the absence of force. In other words, the originally partitioned portion 612 keep the connected light bar sections 611, 613 straight, while in the case of external force, an angle generated between the light bar sections 611, 613. After the release of external force, because of a certain rigidity of the partitioned portion 612, the relative bending angle between the light bar sections 611, 613 can be maintained at that time. In addition, a cooling element 615, such as an aluminum sheet, or the like, may be provided on the back surface of the light bar 61.

In another embodiment, the substrate of the LED light bar is a flexible circuit board. It can be bent under a certain external force, and maintained the shape at that time after the external force removed. For example, the flexible circuit board may be made of aluminum or other material. When the external force exceeds a certain limit, the LED light bar will bend. However, after the external force disappeared, the LED light bar can maintain its curved shape due to the rigidity of the flexible circuit board itself.

In addition, glue can be applied to all or a portion of the LED light bar. Specially, the glue could a cooling glue. When the LED light bar contacts to the inner wall of the lamp shell bulb because of the external force, which is produced by balloon expansion, the glue can make the LED light bar fixed better with the inner wall of the bulb shell. For example, the LED light bar will not be damaged because of shifting or shaking during transport. Another approach is to apply the cooling glue to the inner wall of the bulb shell.

In addition, the core of LED can be placed on both sides or one side of the LED light bar. In order to further enhance the cooling effect, some cooling elements, such as aluminum, cooling glue, etc., can be placed on partial or full of one side or both sides of the LED light bar.

In addition, it could be the side with core of the LED light bar toward or contact the side wall of the bulb shell. Alternatively, the side with core also can away from the position near the side wall of the bulb shell. In other words, the LED core can directly emit light toward the inner wall of the closest bulb shell. Or, the LED core may also emit light toward a location further away from the inner wall of the bulb. In this case, a cooling glue further can be applied to the LED light, which near to or contact to a side of the bulb shell, so the heat of the LED light bar can be dissipated through the inner wall of the bulb.

In addition, in another embodiment, the bulb shell and the LED light bar may form a corresponding clamping structures. When the bulb shell is contacted with the LED light bar, the bulb shell and the LED light bar are engaged with each other through the corresponding clamping structure. These clamping structures may be of different configurations such as block, groove, hook, buckle, etc., and the aim is to provide a more stable connection between the LED light bar and the bulb shell.

In addition to the LED light bars, light bulbs usually have other components, such as drive circuit, wireless circuit, speaker, or other element, circuit, etc., which is set for different circumstances. These components, such as the drive circuit, may be connected to the LED light bar by welding or clamping structural. These LED light bars may be electrically connected to each other in series or in another manner. Alternatively, in another embodiment, the plurality of LED light bars may not be contacted with each other.

In one embodiment, the plurality of LED light bars may be connected at the top. Of course, in other embodiments, these LED light bars may also be disconnected.

In this application, a LED light bar can also be logically divided into two parts, known as the LED light bar individually, and thus referred to as the 'the plurality of LED light bars'.

In addition, apart from the plurality of LED light bars described above, another light emitting module may be additionally placed in the same bulb shell. In other words, for example, in order to obtain a stronger light source, a plurality of LED light bars may be provided on the inner wall of the bulb. In addition, a light emitting module, such as a light source plate, or even another group of LED light bars is additionally provided in the center of the bulb shell, surrounded by the plurality of LED light bars described above.

Another embodiment of the instant disclosure provides a bulb device, comprising a bulb shell, a light bar module, a driving circuit and a bulb holder. A The light bar module is mounted in said bulb shell. The light bar module has a plurality of LED light bars, which is expanded toward the position near the inner edge of the bulb shell individually. In the first embodiment, a part or all of the LED light bars directly contact the inside of the bulb shell, so that the heat dissipation effect can be increased. In another embodiment, a part or all of the LED light bars do not directly contact the bulb shell, but expanded a certain degree along the inner wall of the bulb shell. For example, the bulb shell has a relatively narrow neck portion. These LED light bars are closer to each other at the positions corresponding to the neck portions of the bulb shells, and deployed at the position away from the neck portions to get closer to the inner wall of the bulb shell. As the bulb shell itself is an important source of heat, the LED light bulb closer to the shell, the cooling effect is usually better. On the other hand, because of expanding, the heat generated by the LED light bar would not be interfered or overlaid by each other. In particular, the temperature near the LED light bar is often one of the key factors in determining the service life of the LED light bar.

The bulb device also has a drive circuit connected to said light bar module. The bulb holder has two electrical connection terminals for connecting external power to said drive circuit and then driving said light bar module to generate illumination.

As described above, said LED light bar has two or more light bar sections, and a partitioned portion located between the sections. Said plurality of LED light bars are capable of being individually expanded toward the position near the inner edge of the bulb shell and deformed when the plurality of LED light bars are expanded outwardly by an expanding structure. And the plurality of LED light bars continue to retain the shape at the time when the expansion force is removed.

The substrate of said every LED light bar could be a flexible circuit board. It can be bent under a certain external force, and maintained the shape at that time after the external force removed.

In addition, a glue can be applied to a predetermined position of said LED light bar, and said LED light bar and said bulb shell are fixed through said glue.

In addition, said bulb shell and said LED light bar may have a corresponding clamping structures. Said bulb shell and said LED light bar are engaged with each other through said corresponding clamping structure.

In some embodiments, said plurality of LED light bars of the light bar module are connected at the top. This approach can make the assembly is not easy to break up.

In one embodiment, said LED light bar is provided with a cooling element, such as aluminum or cooling glue, and the like, at a position facing the back of the bulb shell.

In addition, in another embodiment, another light emitting module may additionally be added, and located between said plurality of LED light bars.

In another embodiment, said light bar module comprises two or more sub-light bar modules, each has a plurality of LED light bars respectively.

Figure 7:
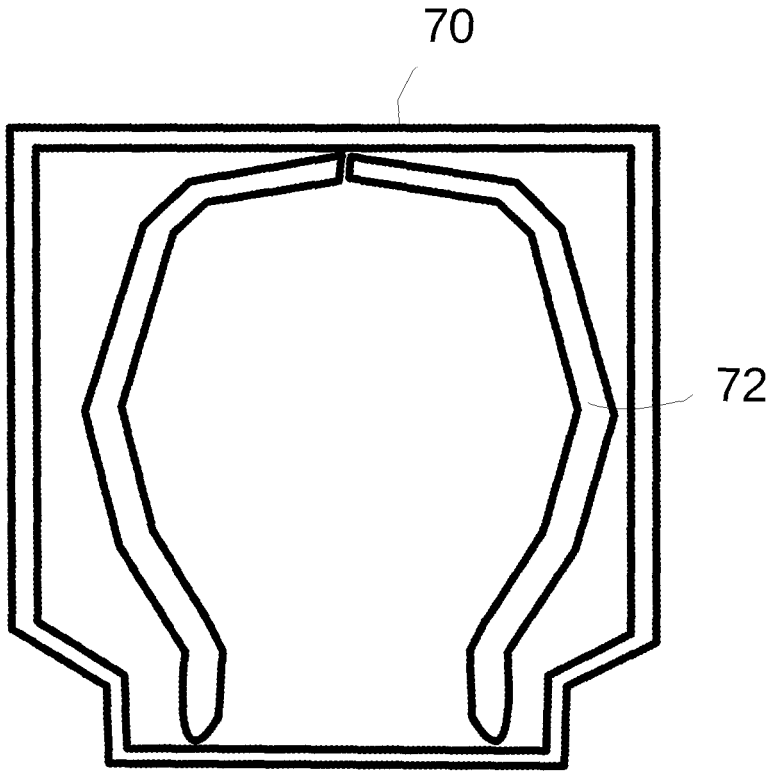
FIG. 7 illustrates a schematic view of another bulb device according to an embodiment of the present disclosure.

Please refer to FIG. 7. FIG. 7 illustrates a schematic view of another bulb device according to an embodiment of the present disclosure. In addition to being made into a light bulb product, the inventive concept described above also can be used as other lighting devices. The illumination device has a translucent shell 70, and the above-described light bar module 72. For example, such a lighting device may be a flashlight, table lamp, lamps depend on battery or other various products in lighting or indicating assembly.

In addition to these practices, the LED light bars may also be provided on a substrate having a certain elasticity to reduce the overall width between the LED light bars before plunging into the neck of the bulb housing. When the LED light bar is inserted into the bulb shell, and it will be expanded because of the elasticity of the LED light bar. A shrinkable band which may be melted by heating, or other operable wires, etc. Also can be used for such assembling operations.

Figure 8A:
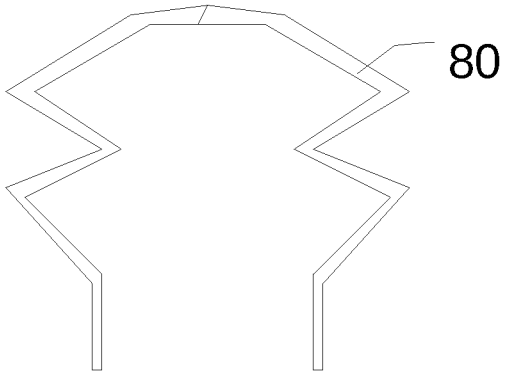
FIG. 8A illustrates a schematic view of an expended LED light bar according to an embodiment of the present disclosure.
Figure 8B:
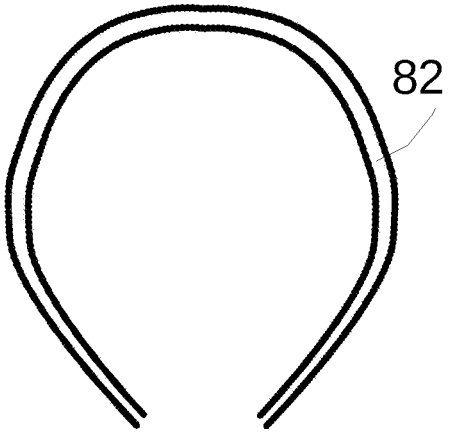
FIG. 8B illustrates a schematic view of another expended LED light bar according to an embodiment of the present disclosure.

Please refer to FIG. 8A and FIG. 8B. FIG. 8A illustrates a schematic view of an expended LED light bar according to an embodiment of the present disclosure. FIG. 8B illustrates a schematic view of another expended LED light bar according to an embodiment of the present disclosure. In addition, it is not quite necessarily for the LED light bar to extend from the neck portion of the bulb to the upper portion. For example, the LED light bar may be spiral extended, or the direction of extension is perpendicular to the direction from the neck of the bulb into the bulb. Other arrangements of the LED light bar should also be considered as other embodiments of the invention. For example, in FIG. 8A, not all of the expanded manner of the light bar 80 is toward the inner wall of the bulb shell, and a portion of the light bar 80 may be bent to achieve the effect of the set optical path. In FIG. 8B, the expanded manner of the light bar 82 is a curve, not a polygon. As described here, the designers should know the other derivative expanded manner also should fall within the scope of the present invention.

Figure 9A:
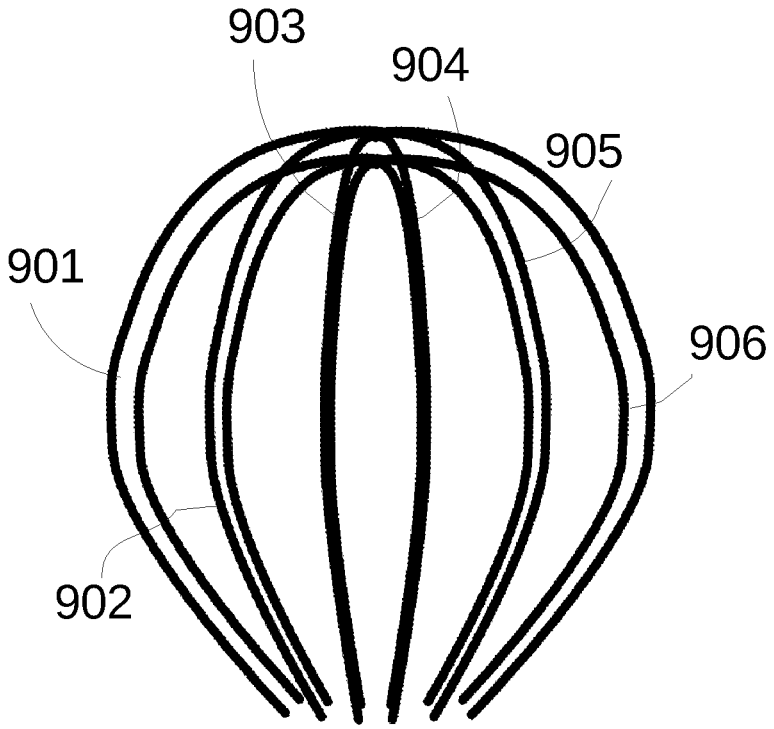
FIG. 9A illustrates a schematic view of staggered configuration of two or more light bar modules according to an embodiment of the present disclosure.

Please refer to FIG. 9A. FIG. 9A illustrates a schematic view of staggered configuration of two or more light bar modules according to an embodiment of the present disclosure. In FIG. 9A, a light bulb shell is internally provided with two sets of LED light bars, wherein the first set of LED light bars have light bars 901, 903, 905, and the second set of LED light bars have light bars 902, 904, 906. The first set of LED light bars can be staggered with the second set of LED light bars, so that the light bar can be more closely spaced against the inner wall of the bulb shell during expansion.

Figure 9B:
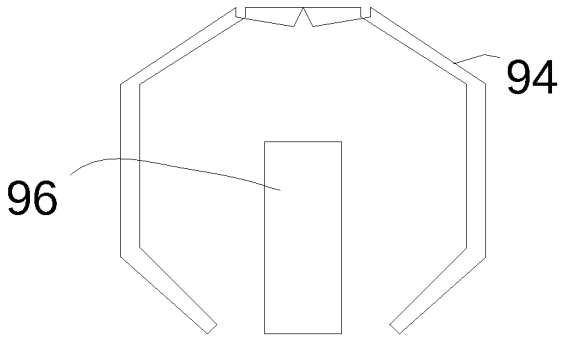
FIG. 9B illustrates a schematic view of an embodiment with another light emitting module according to an embodiment of the present disclosure.

Please refer to FIG. 9B. FIG. 9B illustrates a schematic view of an embodiment with another light emitting module according to an embodiment of the present disclosure. In addition to the light module 94 described above, another light emitting module 96 may be added. A variety of different design requirements can be further reached through a light bar module 94 adjacent to or in contact with the inner wall of the bulb shell and an additional light emitting module 96.

In addition to the above embodiments, the other corresponding modifications, component replacements, or functional, and structural changes as long as it is within the concept of the present invention, all should and can belong to the scope of the present invention, and not limited to the specific parameters or combinations of permutations in the examples.

What is claimed is:

1. A method for installing a light bar module into a light bulb, comprising:

placing an expansion structure into the light bar module;

placing the light bar module into a bulb shell, wherein said light bar module having a plurality of LED light bars, unexpanded and disposed between the plurality of LED light bars, each LED light bar having a certain bending property;

expanding the expansion structure to make the plurality of LED light bars bent toward the bulb shell;

reducing said expansion structure;

separating said expansion structure from said light bar module; and mounting other elements of the light bulb.

2. The method of claim 1, wherein said expansion structure is a balloon, and said balloon is inflated to expand said expansion structure, and said balloon is exhausted to reduce said expansion structure.

3. The method of claim 1, wherein the LED light bar has at least two light bar sections, there is a partitioned portion located between two adjacent light bar sections, the LED light bars is bent at the partitioned portions when said expansion structure is deformed against said light bar module.

4. The method of claim 3, wherein said partitioned portion maintains a shape when no force is applied on said portioned portion.

5. The method of claim 1, wherein a substrate of the LED light bar is a flexible circuit board, bent under a certain external force, but maintained a shape after an external force is removed.

6. The method of claim 1, further comprising gluing at a predetermined position of said LED light bar for fixing relative positions between said LED light bar and said bulb shell.

7. The method of claim 1, further comprising forming a corresponding clamping structure on said bulb shell and said LED light bar, when said bulb shell is contacted to said LED light bar, said bulb shell and said LED light bar is engaged with each other through said corresponding clamping structure.

8. The method of claim 1, wherein said mounting other elements includes mounting a driving circuit connecting to said light bar module.

9. The method of claim 1, wherein said plurality of LED light bars of the light bar module are connected at a top portion of the light bar module.

10. The method of claim 1, further comprising setting a cooling element on said LED light bar facing the back of the bulb shell.

11. The method of claim 1, further comprising mounting another light emitting module into said bulb shell, wherein said another light emitting module is surrounded by said plurality of LED light bars.

* * * * *